United States Patent [19]

Mori et al.

[11] Patent Number: 4,930,303

[45] Date of Patent: Jun. 5, 1990

[54] SPINNING APPARATUS

[75] Inventors: Hideshi Mori, Joyo; Hisaaki Kato; Mitsuhiko Miyaoka, both of Shiga; Hiroshi Yamaguchi, Kyoto, all of Japan

[73] Assignee: Murata Kikai Kabushiki Kaisha, Kyoto, Japan

[21] Appl. No.: 201,041

[22] Filed: May 31, 1988

[30] Foreign Application Priority Data

Jun. 2, 1987 [JP] Japan ..... 62-85849[U]
Jan. 27, 1988 [JP] Japan ..... 63-16146

[51] Int. Cl.[5] ..... D01H 5/28; D02G 1/04

[52] U.S. Cl. ..... 57/328; 57/331; 57/333; 57/336; 57/348

[58] Field of Search ..... 57/328, 331–334, 57/401, 1 R, 336, 343, 261, 262, 346, 348

[56] References Cited

U.S. PATENT DOCUMENTS 4,545,193 10/1985 Tanaka et al. ..... 57/328 X
4,550,560 11/1985 Tanaka et al. ..... 57/261
4,674,274 6/1987 Kato ..... 57/328

FOREIGN PATENT DOCUMENTS 60-88132 5/1985 Japan .

*Primary Examiner*—John Petrakes
*Attorney, Agent, or Firm*—Spensley, Horn, Jubas & Lubitz

[57] ABSTRACT

A spinning apparatus comprising a drafting device, an air jet nozzle and a false twisting unit including a pair of endless belts lying in surface contact with each other at a yarn nip point, the drafting device, air jet nozzle, and false twisting unit being located in a path of yarn travel in the order named, the air jet nozzle and the false twisting unit being both movable away from the path of yarn travel, the air jet nozzle and the false twisting unit being movable to and away from each other.

19 Claims, 6 Drawing Sheets

SPINNING APPARATUS

FIELD OF THE INVENTION

This invention relates to a spinning apparatus, and more particularly, to one having an air jet nozzle and false twisting belts as twisting members.

RELATED ART STATEMENT

A spinning apparatus of the type to which this invention pertains is known as disclosed in Laid-Open Patent Specification No. 88132/1985. A bundle of staple fibers is drafted by a drafting device comprising back, middle and front rollers, and is introduced into an air jet nozzle. The nozzle emits a whirling stream of compressed air which causes the bundle of the fibers to form a balloon whirling about the nip point of the front rollers in the same direction with the whirling stream of compressed air, while the fibers forming the bundle are shifted relative to one another. The staple fibers which have left the air jet nozzle are nipped between the endless belts of a false twisting unit which cross each other, and are twisted between the nipping surfaces thereof to deliver a spun yarn.

As the false twisting unit is provided for receiving and twisting the fiber bundle which has been effected the whirling and shifting of the fibers by the air jet nozzle, the nipping surfaces of the endless belts are positioned close to the outlet of the air jet nozzle. Therefore, the maintenance and inspection of the endless belts in the false twisting unit have been a very difficult job.

The maintenance and inspection of the air jet nozzle has also been a very difficult job, as it is located close to the front rollers.

OBJECT AND SUMMARY OF THE INVENTION

It is an object of the present invention to provide a spinning apparatus which is very easy to inspect and maintain constituting devices thereof.

According to this invention, therefore, there is provided a spinning apparatus comprising a drafting device, an air jet nozzle and a false twisting unit including a pair of endless belts lying in surface contact with each other at a yarn nip point, the drafting device, air jet nozzle, and false twisting unit being located in a path of yarn travel in the order named, the air jet nozzle and the false twisting unit being both movable away from the path of yarn travel, the air jet nozzle and the false twisting unit being movable to and away from each other.

BRIEF DESCRIPTION OF DRAWINGS

FIGS. 1 and 2 are side elevational views of a spinning apparatus embodying this invention, FIG. 1 showing its normal operating position, while FIG. 2 shows its maintenance position;

DETAILED DESCRIPTION OF PREFERRED EMBODIMENTS

Figure 1:
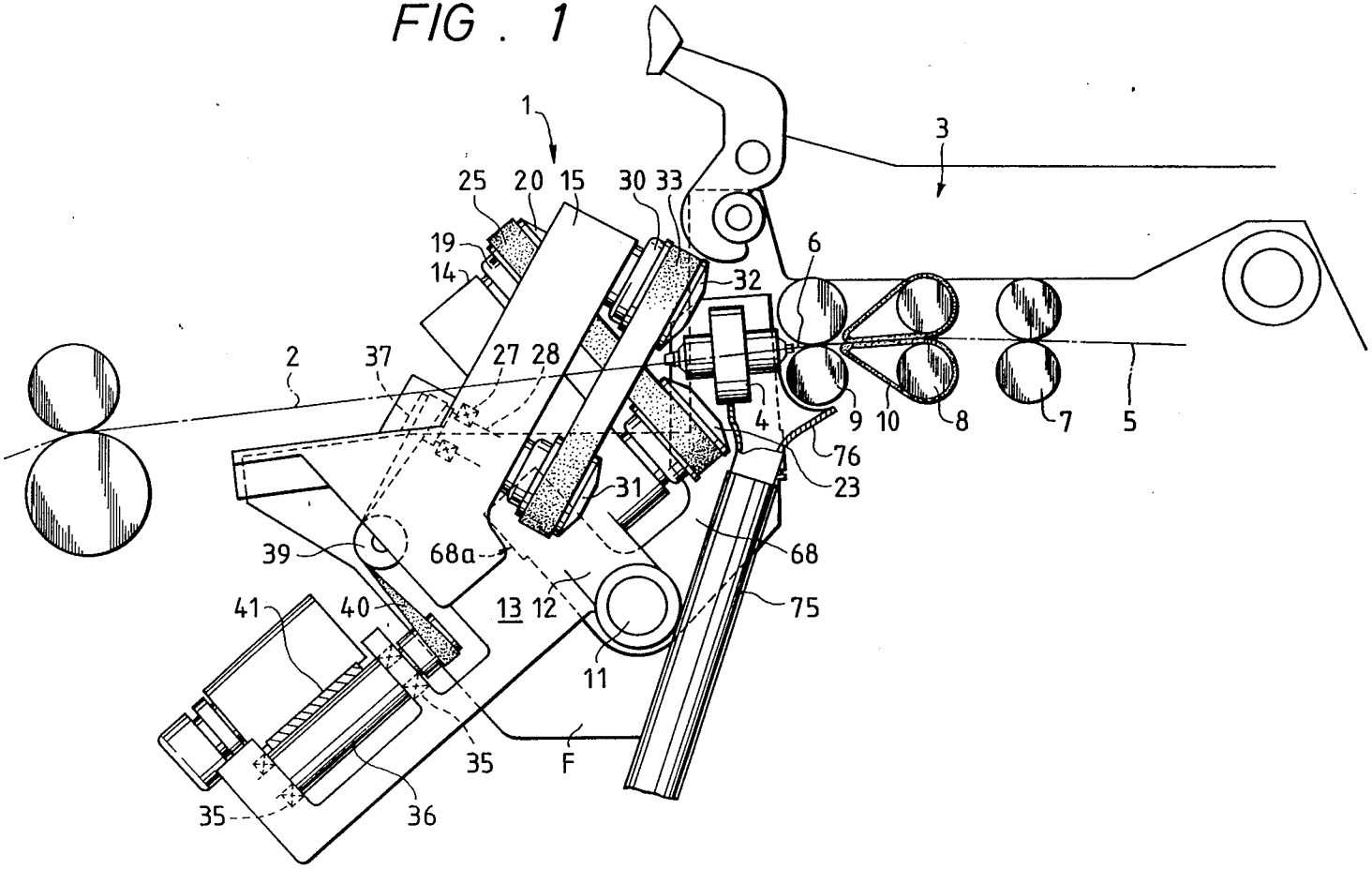

The invention will now be described by way of example with reference to the drawings.

The spinning apparatus of this invention is used for manufacturing a spun yarn from a bundle of fibers and comprises a drafting device 3, an air jet nozzle 4 and a false twisting unit 1.

The drafting device 3 is a known device which drafts a bundle 5 of staple fibers to form a fiber bundle 6 and delivers it to the air jet nozzle 4. It comprises a pair of back rollers 7, a pair of middle rollers 8 and a pair of front rollers 9. An apron 10 is provided on the middle rollers 8.

The air jet nozzle 4 is positioned close to the front rollers 9 in the drafting device 3. The air jet nozzle 4 directs a jet stream of air tangentially to the fiber bundle 6 passing through its main body to cause the fiber bundle 6 to form a balloon, and the constituent fibers thereof to be shifted relative to one another.

The false twisting unit 1 is constructed as will hereinafter be described.

A supporting shaft 11 lies in a row in which a plurality of spinning units each comprising a drafting device 3, an air jet nozzle 4 and a false twisting unit 1 are juxtaposed to form the spinning apparatus. An arm 12 is rotatably supported on the shaft 11 and forms an integral part of a rotating base 13. The supporting shaft 11 projects laterally from the frame F of the drafting device. A first endless belt supporting arm 14 and a second endless belt supporting arm 15 are integrally secured to the rotating base 13. A driven pulley 20 is rotatably supported on the first endless belt supporting arm 14 by a bearing member 19 which is guided by a guide bar not shown slidably in a belt direction. A first driving shaft 22 is supported by a bearing 21 and extends through the first endless belt supporting arm 14 and the rotating base 13. A driving pulley 23 is provided at the upper end of the first driving shaft 22, and a prime pulley 24 at the lower end thereof. An endless false twisting belt 25 extends between the driven and driving pulleys 20 and 23. The belt 25 is always held under tension by a spring fitted in the guide bar and acting on the bearing member 19.

A second driving shaft 28 is supported by a bearing 27 on the base portion of the second endless belt supporting arm 15. As is the case with the first endless belt supporting arm 14, a bearing member 30 is supported slidably by a guide bar not shown, a driving pulley 31 and a driven pulley 32 are provided on the second driving shaft 28 and a shaft (not shown) supported on the bearing member 30, respectively, and an endless false twisting belt 33 extends between the two pulleys. The belt 33 is held under tension by the resilient force of a spring acting on the bearing member 30. A prime pulley 36 is supported on the rotating base 13 by a shaft (not shown) supported by a bearing member 35. A driving belt 40 extends between the prime pulley 36 and a driving shaft pulley 37 provided at one end of the second driving shaft 28, and past an intermediate pulley 39. The intermediate pulley 39 is supported on the rotating base 13. A driving belt 41 lying longitudinally of the machine frame and adapted to receive the transmission of power from a prime mover not shown is in contact with the prime pulleys 24 and 36.

An idler pulley holds the belt 41 in contact with the prime pulleys 24 and 36.

Figure 3:
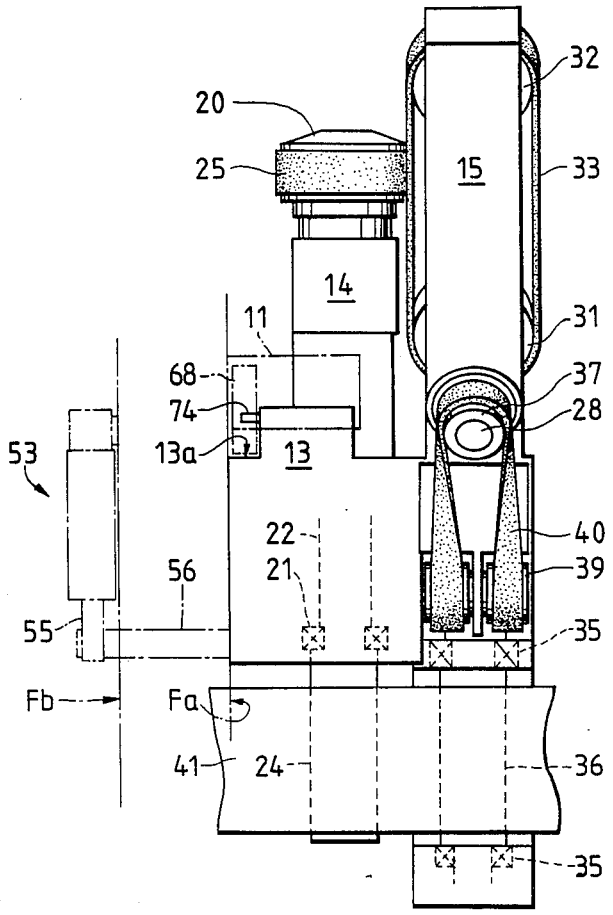
FIG. 3 is a front elevational view of a false twisting unit.

The rotating base 13 rotates about the supporting shaft 11, while sliding on the sidewall Fa of the supporting frame F for the drafting device 3 (FIG. 3). A restraining member is provided on the frame F for restraining the range of rotation of the rotating base 13.

Figure 4:
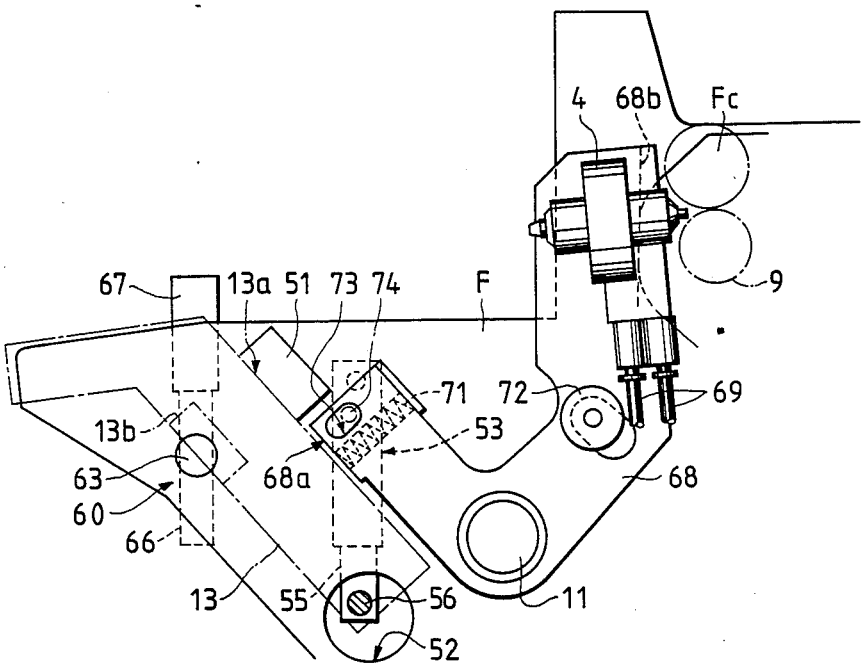
FIG. 4 is a side elevational view of the apparatus of FIG. 1 from which the false twisting unit has been removed.

The frame sidewall Fa is formed with a projecting block 51 on which the rotating front surface 13*a* of the rotating base 13 is adapted to abut, so that the block 51 may stop the clockwise rotation of the rotating base 13, as viewed in FIG. 4, upon abutment of its front surface 13*a* on the block 51.

A connecting member 53 extends through a hole 52 in the frame F and connects a part of the rotating base 13 and the rear surface Fb of the frame F for limiting the counterclockwise rotation, as viewed in FIG. 4, of the rotating base 13 (FIGS. 3 and 4).

Figure 6:
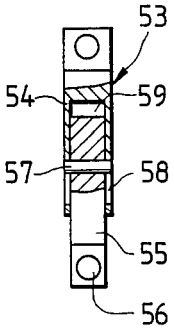
FIG. 6 is a cutaway view of a connecting member.

The connecting member 53 comprises a cylindrical member 54 having one end secured to the rear surface Fb of the frame and a piston member 55 inserted axially movably in the cylindrical member 54, as shown in FIG. 6. The piston member 55 has one end connected to a rod 56 secured to the rotating base 13. A pin 57 is secured to the piston member 55 and the cylindrical member 54 is provided in its sidewall with slots 58 in which the pin 57 is movable, so that the piston member 55 may be axially movable along a certain distance in the cylindrical member 54.

When the rotating base 13 is rotated counterclockwise from its position shown in FIG. 4, the air in the space 59 between the cylindrical member 54 and the piston member 55 provides a cushion which imparts an appropriate amount of resistance to the advancing motion of the piston member 55 (i.e., the rotating base 13 is rotated at a low speed), and as soon as the pin 57 reaches the ends of the slots 58, the piston member 55 discontinues its advancing motion and thereby stops the rotation of the rotating base 13.

The frame F is provided with a locking mechanism 60 which holds the rotating base 13 in position after it has been rotated clockwise as viewed in FIG. 4 until its front surface 13*a* abuts on the block 51.

Figure 5:
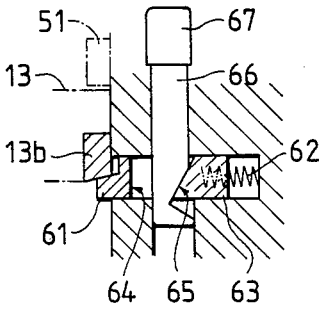
FIG. 5 is a cutaway view of a locking device.

Referring more particularly to the locking mechanism 60, the frame F is provided with a first axially movable member 63 having one end which projects toward the rotating base 13 and forms a pawl 61 engaging an engaging portion 13*b* of the rotating base 13, while a spring 62 is provided at the other end thereof for urging the pawl 61 to stay in its projecting and engaging position, and a second axially movable member 66 having a tapered portion 65 engaging a tapered recess 64 made in the mid-portion of the first axially movable member 63, the second axially movable member 66 having a head 67 projecting from the front surface of the frame F, as shown in FIGS. 4 and 5.

If the second axially movable member 66 is pushed down as viewed in FIG. 5, the first axially movable member 63 is retracted to the right as viewed in FIG. 5 and the pawl 61 is disengaged from the rotating base 13 leaving it freely rotatable. If the freely rotatable base 13 is manually rotated again clockwise as viewed in FIG. 4 and the engaging portion 13*b* thereof is moved past the pawl 61, the spring 62 urges the pawl 61 to project into engagement with the rotating base 13 and thereby disable any further rotation thereof.

A structure for supporting the air jet nozzle 4 will now be described with reference to FIGS. 3 and 4.

An L-shaped arm plate 68 is rotatably supported on the supporting shaft 11 and has one end to which the air jet nozzle 4 is secured. A flexible pipe 69 is provided for supplying compressed air to the air jet nozzle 4.

The other end of the arm plate 68 is located in close proximity to the block 51 and has a flat surface 68*a* facing the front surface 13*a* of the rotating base 13. A spring 71 abutting on the front surface 13*a* is embedded in the arm plate 68 adjacent to the other end thereof so that its expanding force may urge the arm plate 68 to rotate clockwise as viewed in FIG. 4 away from the rotating base 13. A member 72 is provided for pushing the arm plate 68 toward the frame F so that it may slidably contact the sidewall Fa of the frame.

The arm plate 68 has an elongate hole 73 at the other end thereof and a pin 74 projects from the rotating base 13 into the hole 73. If the rotating base 13 is rotated counterclockwise from its position shown in FIG. 4, the pin 74 causes the arm plate 68 to rotate counterclockwise.

Therefore, the spring 71 expands by a length corresponding to the stroke of movement of the pin 74 along the elongate hole 73 and the distance G1 between the air jet nozzle 4 and the false twisting unit 1 is thereby increased.

The arm plate 68 has a shoulder 68*b* at one end and the shoulder 68*b* has a front surface adapted to abut on a portion Fc projecting from the frame F of the drafting device, whereby the clockwise rotation, as viewed in FIG. 4, of the arm plate 68 is limited.

Figure 2:
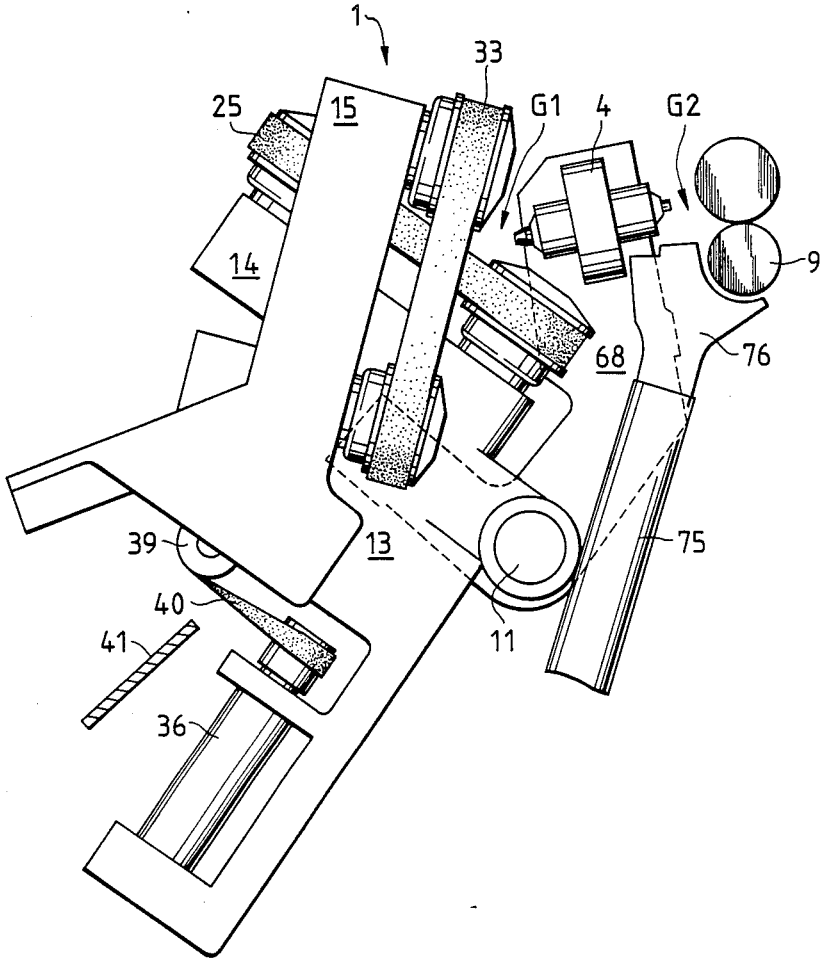

FIG. 1 shows the apparatus in its normal operating position reached when the rotating base 13 and the arm plate 68 have both been rotated clockwise. FIG. 2 shows its maintenance position reached when both of the rotating base 13 and the arm plate 68 have been rotated counterclockwise to increase both the distance G2 between the front rollers 9 and the air jet nozzle 4 and the distance G1 between the air jet nozzle 4 and the false twisting unit 1.

A suction pipe 75 is secured to the frame F for drawing air from the air jet nozzle 4 and is provided at its end with a connecting member 76 having an opening so shaped as to be complementary to the external shape of the air jet nozzle 4. In the operating position of the apparatus shown in FIG. 1, the pipe 75 and the nozzle 4 are connected to each other in an airtight way, while in the position shown in FIG. 2, they are separated from each other.

Description will now be made of the operation of the apparatus as hereinabove described.

FIG. 1 shows the apparatus in its operating position. The bundle 5 of staple fibers which has been fed to the drafting device 3 is drafted to form the fiber bundle 6 having an appropriate thickness, while passing through the nips between the back rollers 7, between the middle rollers 8 and between the front rollers 9, and the fiber bundle 6 is introduced into the air jet nozzle 4. The air jet nozzle 4 has a cylindrical main body through which the fiber bundle 6 is passed axially, and which is provided with jet apertures for discharging jets of compressed air tangentially to the fiber bundle. The jets of compressed air cause the fiber bundle 6 to form a balloon extending in the same direction as the jets, and the staple fibers in the fiber bundle to be shifted from one another. This shifting gradually increases from the inside of the bundle of staple fibers to its outside and the liberation of fibers arises mainly from the complete separation of fibers in the outer layer of the bundle. The fibers which have been separated from the outer layer are strongly twisted and bundled between a first balloon control ring in the air jet nozzle 4 and the false twisting unit 1, and after passing through the false twisting unit 1, they are strongly untwisted. As a result of the untwisting, the fibers which have slipped are twisted and the fibers which have been separated from the outer layer are strongly wound about the fibers in the inner layer, whereby a bundled spun yarn 2 comprising a mixture of twisted and intertwined fibers is produced.

In the false twisting unit 1, the prime pulleys 24 and 36 engaging the driving belt 41 are rotated by the power which is transmitted from the driving belt 41. The rotation of the prime pulley 24 causes the rotation of the first driving shaft 22 which in turn causes the rotation of the driving pulley 23, whereby the first endless false twisting belt 25 extending between the driving pulley 23 and the driven pulley 20 is moved round. The rotation of the prime pulley 36 is transmitted to the driving shaft pulley 37 and the second driving shaft 28 through the intermediate pulley 39, and as a result, the driving pulley 31 is rotated. The rotation of the driving pulley 31 causes the second endless false twisting belt 33 to move around the driven pulley 32 and the driving pulley 31. Therefore, the fiber bundle 6 which has left the air jet nozzle 4 and is held between the overlapping surfaces of the first and second false twisting belts is twisted and the spun yarn 2 is delivered from the false twisting unit 1.

If there has arisen any necessity for the exchange of the endless false twisting belts 25 and 33 or the maintenance and inspection of the false twisting unit 1, the second axially movable member 66 which is shown in FIGS. 4 and 5 is pushed down to retract the pawl 61 into the frame F. This results in the rotation of the rotating base 13 to its position shown in FIG. 2 by its own weight, or by the operator's manual movement thereof, while the pin 74 engaging the elongate hole 73 causes the arm plate 68 to rotate to its position shown in FIG. 2, too.

As a result of such rotation, the endless false twisting belts 25 and 33 which are supported by the endless belt supporting arms 14 and 15, respectively, on the rotating base 13 are rotated away from the path of travel of the fiber bundle 6 or the spun yarn 2 and are also moved away from the drafting device 3 and the air jet nozzle 4, whereby a widened open space is formed around the nozzle 4 and the endless belts 25 and 33.

At the same time, the prime pulleys 24 and 36 for driving the endless belts 25 and 33 are both separated from the belt 41 connected to a source of drive power and therefore stop rotating.

When the false twisting unit 1 has been rotated as hereinabove described, the endless false twisting belts 25 and 33 are inspected or changed, or the maintenance work on any other portion is carried out. When the necessary maintenance work has been finished, the rotating base 13 is manually rotated clockwise as viewed in FIG. 1 until its front surface 13*a* abuts on the block 51, whereupon the pawl 61 projects into engagement with the rotating base 13 to hold it in position.

In the apparatus as hereinabove described, the prime pulleys 24 and 36 are moved away from the belt 41 toward the frame of the apparatus when the rotating base 13 is rotated, and the belt 41 can be positioned farther away from the frame and closer to the operator than the prime pulleys 24 and 36 are. This arrangement facilitates the maintenance and inspection of the belt 41 including its exchange. However, it is also possible to provide the center of rotation of the rotating base 13 below the belt 41 so that the prime pulleys 24 and 36 may be movable away from the belt 41 toward the operator.

Figure 7:
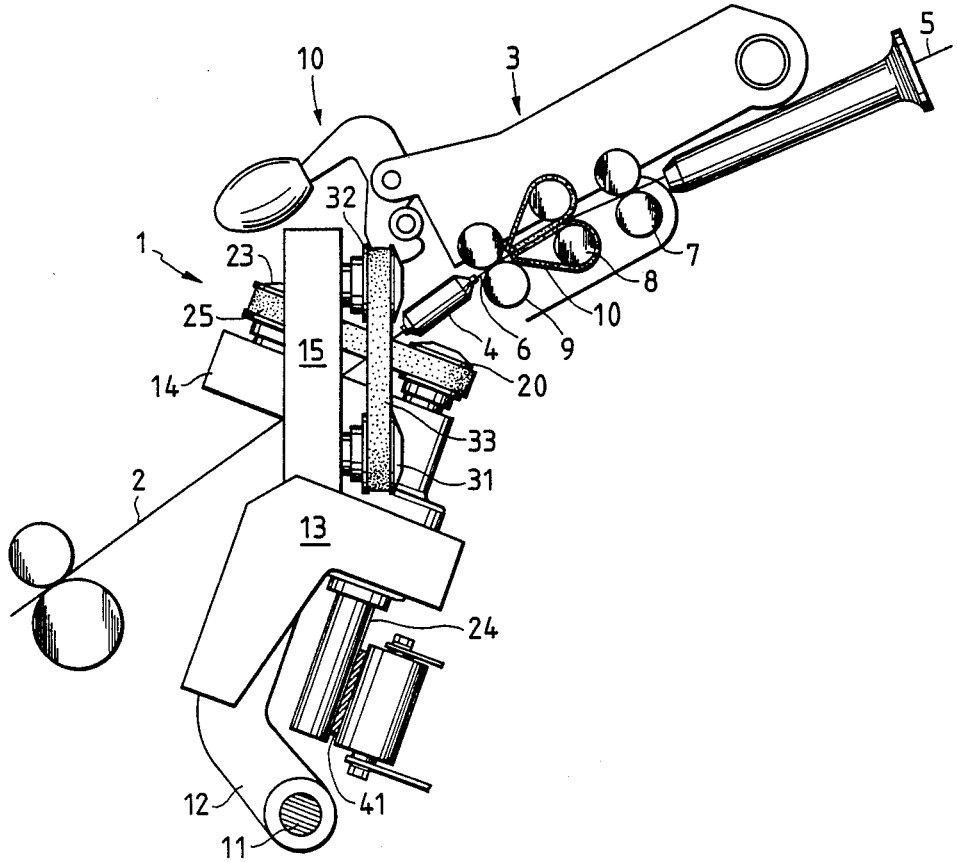
FIGS. 7 to 9 show another embodiment of this invention, FIG. 7 being a side elevational view thereof, FIG. 8 being a perspective view thereof, and FIG. 9 being a cutaway view of a locking member.

More specifically, the supporting shaft 11 is positioned immediately below the belt 41 and the rotating base 13 is supported by the rotatable arm 12 on the shaft 11, as shown in FIG. 7.

In this case, the rotating base 13 is supported in position by a mechanism which will hereinafter be described with reference to FIGS. 8 and 9.

Figure 8:
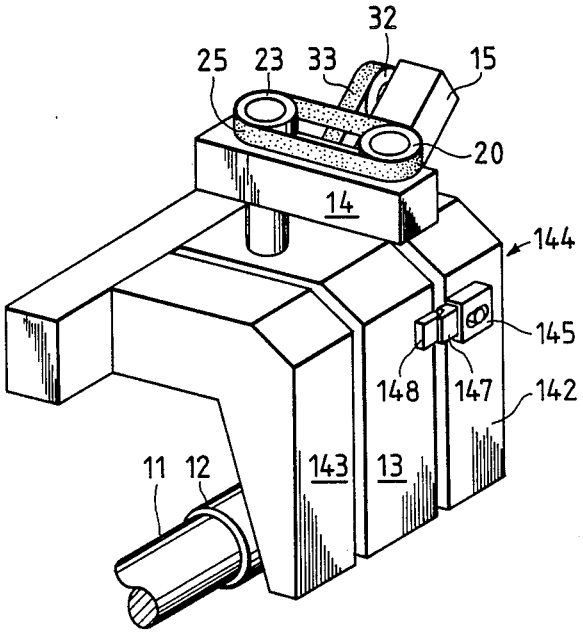
Figure 9:
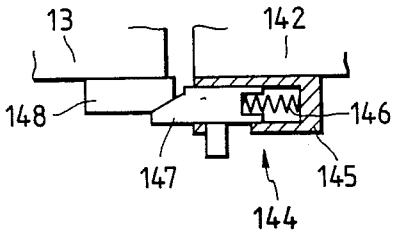

The supporting shaft 11 extends through all the spindles and fixed frames 142 and 143 are provided on the opposite sides, respectively, of the rotating base 13, as shown in FIG. 8. If the rotating base 13 is not rotated, it is secured to the fixed frame 142 by a locking member 144. The locking member 144 comprises a guide body 145 attached to the fixed frame 142, a stopper 147 located in the guide body 145, a spring 146 provided in the guide body 145 for urging the stopper 147 to project from the guide body 145, and a stopper receiver 148 attached to the rotating base 13. When the stopper 147 has projected, it engages the stopper receiver 148 to disable its movement and thereby hold the base 13 in position.

As is obvious from the foregoing description, the spinning apparatus of this invention is very easy to maintain, as only a single operation is required for moving the air jet nozzle and the false twisting unit away from the path of yarn travel and widening the gaps between the drafting device and the air jet nozzle and between the air jet nozzle and the false twisting unit.

What is claimed is:

1. A spinning apparatus comprising a drafting device, an air jet nozzle and a false twisting unit including a pair of endless belts lying in surface contact with each other at a yarn nip point, said device, nozzle and unit being located in a path of yarn travel in the order named, said apparatus further comprising a support structure movably supporting said air jet nozzle and said false twisting unit for movement of both said air jet nozzle and said false twisting unit away from said path and for movement of said air jet nozzle and said false twisting unit toward and away from each other.

2. The spinning apparatus as claimed in claim 1, wherein said pair of endless belts are supported by a first and a second endless belt supporting arm, and wherein said support structure comprises a rotating arm, a supporting shaft, and a rotating base to which said first endless belt supporting arm and said second endless belt supporting arm are integrally secured, wherein said rotating base is formed as an integral part of said rotating arm and said rotating arm is rotatably supported on said supporting shaft.

3. The spinning apparatus as claimed in claim 2, wherein said drafting device has a supporting frame provided with a side wall, said rotating base is arranged to rotate about said supporting shaft while sliding on the side wall of the supporting frame for the drafting device, and said supporting frame is provided with a restraining member for restraining the range of rotation of the rotating base.

4. The spinning apparatus as claimed in claim 3, wherein said restraining member comprises a projecting block arranged to restrain the rotation of the rotating base in the direction which the false twisting unit on the rotating base moves toward the draft device, said projecting block being supported by the side wall of said supporting frame on which the rotating base is adapted to abut.

5. The spinning apparatus as claimed in claim 4, wherein said supporting frame is provided with a hole, said apparatus further comprising a connecting member which extends through the hole in the frame and connects a part of the rotating base and the frame to limit the rotation of the rotating base in the direction which the false twisting unit on the rotating base moves away from the draft device.

6. The spinning apparatus as claimed in claim 5, wherein said rotating base is provided with an engaging portion and wherein said apparatus further comprises a locking means for holding the rotating base in position where the rotating base abuts the projecting block, said locking means being provided on the supporting frame, said locking means comprising:

a first axially movable member having one end which projects toward the rotating base and forms a pawl operable for engaging the engaging portion of the rotating base and said first axially movable member having a spring provided at the other end thereof for urging the pawl to stay in its projecting and engaging position, said first axially movable member further having a mid-portion provided with a tapered recess, and a second axially movable member having a tapered portion for engaging the tapered recess in the mid-portion of the first axially movable member, and said second axially movable member further having a head projecting from the front surface of the supporting frame.

7. The spinning apparatus as claimed in claim 2, wherein said support structure further comprises an L-shaped arm plate having one end to which the air jet nozzle is secured, said armplate being rotatably supported on the supporting shaft, the other end of said arm plate having a flat surface facing the rotating base and having a spring secured with the arm plate and abutting the rotating base to urge said arm plate away from the rotating base.

8. The spinning apparatus as claimed in claim 7, wherein said arm plate has an elongate hole and a pin projects from the rotating base into said hole so that the arm plate is rotated according to the rotation of the rotating base whereby upon rotation of the rotating base the spring expands by a length corresponding to the stroke of movement of the pin along the elongated hole and the distance between the air jet nozzle and the false twisting unit is thereby increased.

9. The spinning apparatus as claimed in claim 2, further comprising driving means for driving the first and second endless belts, and wherein said supporting shaft is positioned below the driving means and the rotary base supporting the false twisting unit is rotatably supported by the supporting shaft.

10. The spinning apparatus as claimed in claim 9, further comprising a fixed frame provided adjacent one side of the rotating base and a locking means for securing the rotating base to the fixed frame, said locking means being attached to the rotating base and the fixed frame.

11. A spinning apparatus having an air jet nozzle and a false twisting unit, each being arrangeable in a yarn travelling path, said apparatus comprising:

a support structure movably supporting the air jet nozzle and the false twisting unit for relative movement toward and away from each other;

wherein said support structure comprises:

a first movable member movably supporting the air jet nozzle for movement away from the yarn travelling path;

a second movable member movably supporting the false twisting unit for movement away from the yarn travelling path.

12. A spinning apparatus as claimed in claim 11, further comprising a support shaft rotatably supporting said first and second movable members, wherein upon rotation of the first and second movable members, the air jet nozzle and the false twisting unit are moved away from the yarn travelling path.

13. A spinning apparatus as claimed in claim 11, said apparatus further having a drafting device arranged in the yarn travelling path nearer to the air jet device when the air jet device is arranged in the yarn travelling path than when the air jet device is moved away from the yarn travelling path.

14. A spinning apparatus as claimed in claim 11, further comprising:

a frame arranged to be substantially stationary with respect to the movement of said first and second movable members; and a restraining means, supported by the frame, for restraining the range of movement of at least one of said movable members.

15. A spinning apparatus as claimed in claim 14, wherein said restraining means comprises a projecting block extending from the frame, said projecting block having a surface position to abut said second movable member upon movement of said second movable member to a position out of the yarn travelling path.

16. A spinning apparatus as claimed in claim 15, further comprising a releasable locking device operable to releasably lock said second member in the position where said second member abuts said projecting block.

17. A spinning apparatus as claimed in claim 11, further comprising connecting means for connecting said first and second movable members, wherein movement of one movable member causes movement of the other movable member.

18. A spinning apparatus as claimed in claim 17, wherein said first movable member is provided with an elongated hole therein, and said connecting means comprises a pin extending from the second movable member through the elongated hole in said first movable member.

19. A spinning apparatus as claimed in claim 18, further comprising a spring operatively connected with said pin for urging said pin toward one side of the elongated hole in said first movable member.

* * * * *